US011732963B2

(12) United States Patent
Kishimoto et al.

(10) Patent No.: US 11,732,963 B2
(45) Date of Patent: Aug. 22, 2023

(54) FABRICATION METHOD OF A PLANT FACILITY

(71) Applicant: JGC CORPORATION, Kanagawa (JP)

(72) Inventors: Hiroshi Kishimoto, Kanagawa (JP); Takuya Tsutsui, Kanagawa (JP); Makoto Mikami, Kanagawa (JP); Hiroyuki Koito, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 0 days.

(21) Appl. No.: 17/628,547

(22) PCT Filed: Aug. 14, 2019

(86) PCT No.: PCT/JP2019/031988
§ 371 (c)(1),
(2) Date: Jan. 19, 2022

(87) PCT Pub. No.: WO2021/029051
PCT Pub. Date: Feb. 18, 2021

(65) Prior Publication Data

US 2022/0316797 A1 Oct. 6, 2022

(51) Int. Cl.
*F25J 1/02* (2006.01)
*E04B 1/348* (2006.01)
(Continued)

(52) U.S. Cl.
CPC ..... *F25J 1/0259* (2013.01); *E04B 1/34815* (2013.01); *E04B 1/34869* (2013.01);
(Continued)

(58) Field of Classification Search
CPC .. E04B 1/34869; E04B 1/34815; E04B 1/348; E04H 5/02; F25J 2290/42
See application file for complete search history.

(56) References Cited

U.S. PATENT DOCUMENTS 3,925,679 A * 12/1975 Berman ..... F01K 13/00 290/1 R
5,186,502 A * 2/1993 Martin ..... F16L 39/005 285/179
(Continued)

FOREIGN PATENT DOCUMENTS

JP H06341238 12/1994
JP 2003013621 1/2003
(Continued)

OTHER PUBLICATIONS

"International Search Report (Form PCT/ISA/210) of PCT/JP2019/031988", dated Nov. 5, 2019, with English translation thereof, pp. 1-4.
(Continued)

*Primary Examiner* — Gisele D Ford
(74) *Attorney, Agent, or Firm* — JCIPRNET

(57) ABSTRACT

To reduce work at an installation site when a plant facility is manufactured, modules are conveyed in order from a fabrication yard to the installation site, and expansion and contraction amounts of pipe spools are calculated based on a temperature difference between a temperature at the fabrication yard when the modules are manufactured and a temperature at the installation site when the modules are installed at the installation site. Further, an installation position of a foundation is adjusted toward a direction to cancel out the expansion and contraction amounts of the plurality of pipe spools, and the pipe spool is moved toward the direction to cancel out the expansion and contraction amounts of the plurality of pipe spools. The modules are installed with the positions of the end portions of the pipe spools being adjusted.

5 Claims, 8 Drawing Sheets

(51) Int. Cl.
*E04H 5/02* (2006.01)
*F25J 1/00* (2006.01)
*C10G 5/06* (2006.01)

(52) U.S. Cl.
CPC ..... *E04H 5/02* (2013.01); *F25J 1/0022* (2013.01); *C10G 5/06* (2013.01); *F25J 2290/42* (2013.01); *F25J 2290/60* (2013.01)

(56) References Cited

U.S. PATENT DOCUMENTS

2002/0189173 A1* 12/2002 Staschik ..... F24D 18/00 52/79.1
2013/0283855 A1* 10/2013 Rampp ..... F25J 3/0489 62/643
2015/0001161 A1* 1/2015 Wiemers ..... E21B 43/34 210/201
2015/0240474 A1* 8/2015 Kokoschka ..... E04B 1/34384 52/745.02
2015/0291348 A1* 10/2015 Lopez ..... B65D 90/587 220/1.5
2015/0368136 A1* 12/2015 Raymont ..... C02F 1/001 210/96.1
2017/0260767 A1* 9/2017 Shimono ..... E04B 1/36
2018/0058060 A1* 3/2018 Anderson ..... E04B 1/34861
2018/0297878 A1* 10/2018 Raymont ..... C02F 9/20
2021/0372116 A1* 12/2021 Hillenburg ..... C10G 2/30
2022/0106803 A1* 4/2022 Mahlanen ..... E04B 1/8209

FOREIGN PATENT DOCUMENTS

JP 2004240684 8/2004
JP 2011153421 8/2011
JP 2018185103 11/2018
WO 2014028961 2/2014
WO 2018198572 11/2018

OTHER PUBLICATIONS

"Office Action of Japan Counterpart Application", dated Oct. 26, 2021, with English translation thereof, p. 1-p. 4.

* cited by examiner

TRANSPORTATION

INSTALLATION SITE

FABRICATION METHOD OF A PLANT FACILITY

CROSS-REFERENCE TO RELATED APPLICATION

This application is a 371 application of the international PCT application serial no. PCT/JP2019/031988, filed on Aug. 14, 2019. The entirety of the above-mentioned patent application is hereby incorporated by reference herein and made a part of this specification.

TECHNICAL FIELD

The present invention relates to a technology of fabricating a plant facility including a pipe.

BACKGROUND ART

Plants configured to perform fluid treatment include, for example, natural gas plants configured to liquefy natural gas or separate and recover natural gas liquid, petroleum refining plants configured to distill or desulfurize crude oil or various intermediates, and chemical plants configured to produce petrochemical products, intermediate chemicals, or polymers.

Those plants are structured to have a large number of equipment groups arranged therein. Examples of the equipment groups include static equipment such as towers, vessels, and heat exchangers, and dynamic equipment such as pumps. Further, between those equipment groups, a large number of pipes for transferring fluid between the pieces of equipment are connected. In the plant, those pipes are supported by a frame structure formed by combining steel-frame materials or other materials.

For example, in Patent Literature 1, there is described a technology of dividing a liquefied natural gas (LNG) production facility into a plurality of modules to construct the modules, and transporting the constructed modules to a place (installation site) at which the LNG production facility is to be installed. However, in Patent Literature 1, there is no description about problems that may arise when a module construction site and the installation site are separated far away from each other.

CITATION LIST

Patent Literature

[Patent Literature 1] WO 2014/028961 A1

SUMMARY OF INVENTION

Technical Problem

The present invention has been made in view of the above-mentioned backgrounds, and provides a technology for reducing work at an installation site when a plant facility is manufactured.

Solution to Problem

According to one embodiment of the present invention, there is provided a fabrication method of a plant facility, which is to be provided in a plant configured to perform fluid treatment, and includes a pipe through which fluid is allowed to flow, the method including the steps of: fabricating a plurality of modules at a fabrication yard differing from an installation site of the plant facility, the plurality of modules including frame structures each configured to support a plurality of pipe spools included in the pipe, the plurality of modules being configured to be coupled to each other in a horizontal direction via hook up surfaces formed on side surfaces of the frame structures to form the plant facility, the plurality of pipe spools having end portions protruding from each of the hook up surfaces; transporting each of the plurality of modules manufactured at the fabrication yard to the installation site of the plant facility; calculating, in advance, for the each of the plurality of modules, expansion and contraction amounts of the plurality of pipe spools caused by a temperature difference between a temperature at the fabrication yard before start of transportation of the each of the plurality of modules and a temperature at the installation site after the transportation of the each of the plurality of modules; installing the each of the plurality of modules while performing at least one of the steps of: adjusting an installation position of the each of the plurality of modules with respect to a foundation toward a direction to cancel out the expansion and contraction amounts of the plurality of pipe spools, the foundation being arranged in advance at the installation site so that the hook up surfaces to be coupled to each other of the plurality of modules are allowed to be adjacently opposed to each other; and adjusting a position of an end portion of a pipe spool supported by the frame structure toward the direction to cancel out the expansion and contraction amounts of the plurality of pipe spools; and connecting end portions of the plurality of pipe spools opposed to each other of the plurality of modules having the hook up surfaces arranged adjacently to each other to form the pipe, to thereby manufacture the plant facility.

Further, the fabrication method of a plant facility may have the following features.

(a) In a case of conflicting with a limit to an adjustment amount of the installation position of the each of the plurality of modules with respect to the foundation when the step of adjusting the installation position of the each of the plurality of modules is performed, the step of adjusting the position of the end portion of the pipe spool is performed.

(b) In Item (a), in the step of installing the each of the plurality of modules while adjusting the installation position, the adjustment amount of the installation position is set so that a position of an end portion of one pipe spool selected from the plurality of pipe spools supported by the frame structure is arranged at a position set in advance. The step of adjusting the position of the end portion of the pipe spool is performed for pipe spools other than the one pipe spool.

(c) In Item (a), the step of adjusting the position of the end portion of the pipe spool is performed for pipe spools on a side of a module installed earlier at the installation site.

(d) The step of fabricating the each of the plurality of modules includes a step of fabricating the plant facility at the fabrication yard, and then cutting the plant facility to divide the plant facility into the plurality of modules.

Advantageous Effects of Invention

According to the present invention, when the plurality of modules manufactured at the fabrication yard differing from the installation site of the plant facility are transported to the installation site to couple the pipe spools to each other so that the plant facility is formed, the expansion and contraction amounts of the pipe spools caused by the temperature difference between the temperature at the fabrication yard before the start of the transportation of the modules and the temperature at the installation site after the transportation of the modules are calculated in advance. As a result, the installation position of the foundation and the position of the end portion of the pipe spool can be adjusted toward the direction to cancel out the expansion and contraction amounts of the pipe spools. Therefore, the work of adjusting the position after conveyance to the installation site can be reduced.

DESCRIPTION OF EMBODIMENTS

Figure 1:
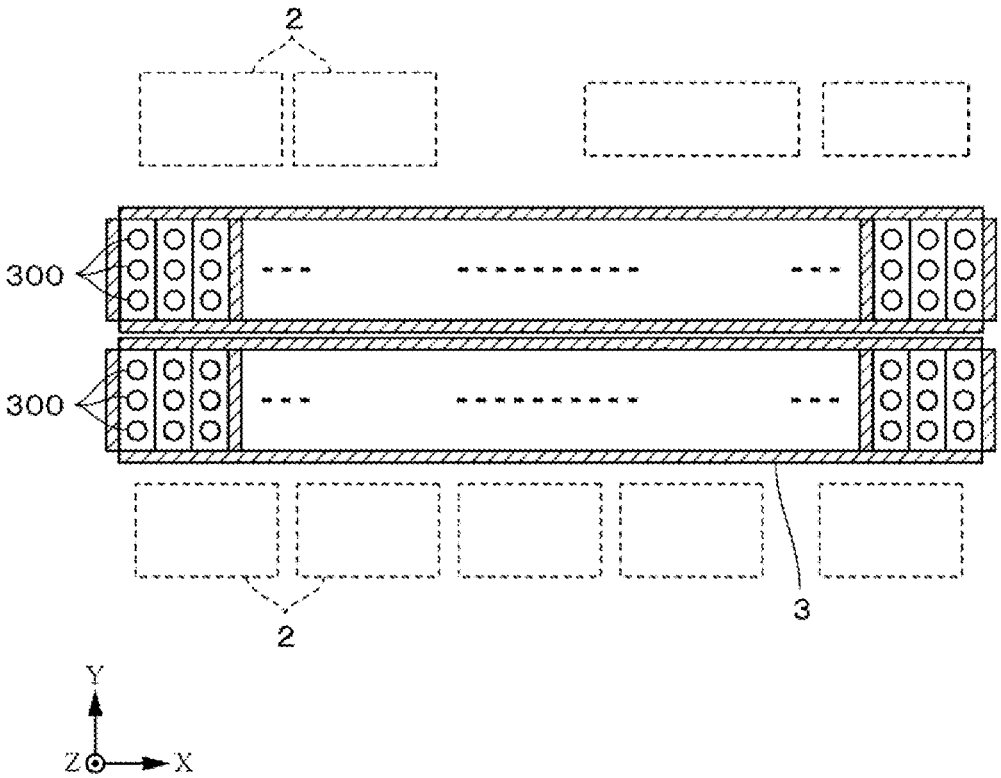
FIG. 1 is a plan view for illustrating an overall configuration of a plant.

FIG. 1 is a plan view for illustrating a plant to be constructed through use of a fabrication method of a plant facility according to an embodiment of the present invention. The plant of FIG. 1 is, for example, an LNG plant configured to perform processing of fabricating liquefied natural gas (LNG) from natural gas corresponding to fluid, and includes a large number of groups of equipment 2 configured to perform liquefaction pretreatment and liquefaction of the natural gas subjected to the pretreatment. Further, a pipe rack 3 is provided so as to be surrounded by those groups of equipment 2. The pipe rack 3 is configured to support pipes 5 through which various types of fluid handled in the LNG plant are allowed to flow for transferring those fluid between the pieces of equipment 2 (also see FIG. 3 for the pipes 5).

The pipe rack 3 and the groups of equipment 2 correspond to a plant facility. Now, description is given of a case in which the fabrication method of a plant facility of this example is applied to the pipe rack 3 corresponding to the plant facility.

Figure 2:
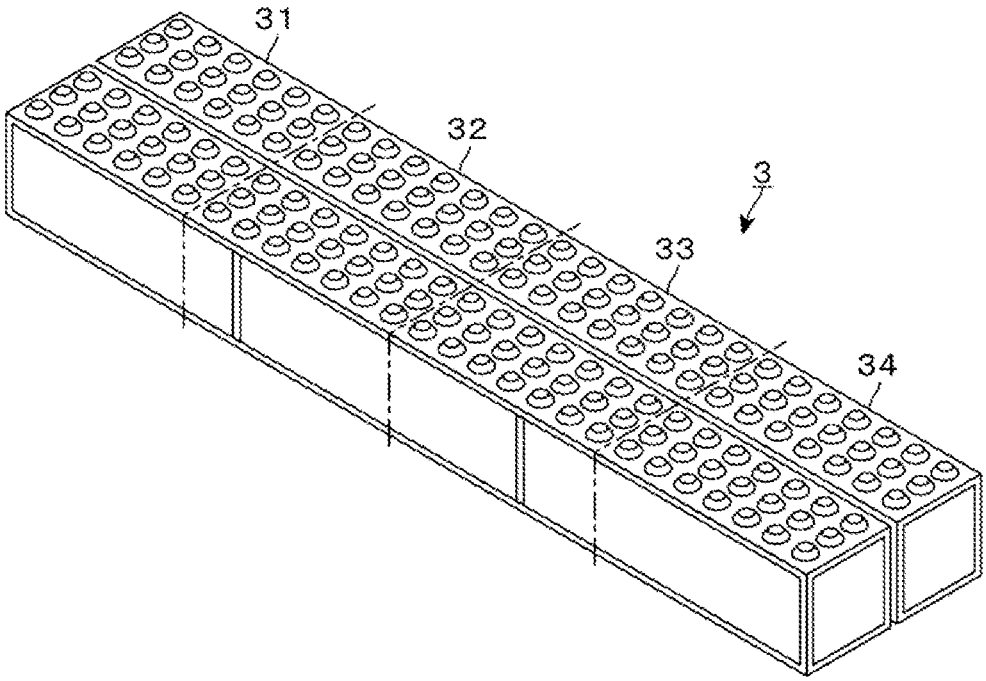
FIG. 2 is a perspective view for illustrating a pipe rack to be installed in the plant.

For example, the pipe rack 3 includes a frame structure configured to support a large number of pipes 5, and a large number of air-cooled heat exchangers (ACHEs) 300 are arranged on an upper surface of the pipe rack 3. As illustrated in FIG. 2, the pipe rack 3 is formed into an elongated planer shape, and a length in its long-side direction is as long as, for example, about 400 m.

The pipe rack 3 having the above-mentioned configuration may be constructed (manufactured) at a fabrication yard differing from an installation site for the purpose of reducing fabricating cost or other reasons. In this case, the completed pipe rack 3 is transported to the site of the plant to install the pipe rack 3. However, as described above, the pipe rack 3 is a giant structure that is as long as about 400 m, and it is difficult to transport the pipe rack 3 as it is.

In view of this, when the pipe rack 3 is transported from the fabrication yard to an installation site, for example, the pipe rack 3 is cut in its long-side direction to transport four divided modules 31 to 34. When the pipe rack 3 is cut, the pipe 5 supported by the frame structure is cut along the long-side direction. The cut pipe 5 is hereinafter referred to as "pipe spool 50".

The pipe spools 50 of the transported modules 31 to 34 are connected to each other so that the pipes 5 are restored. In this manner, the pipe rack 3 is manufactured at the installation site.

Figure 3:
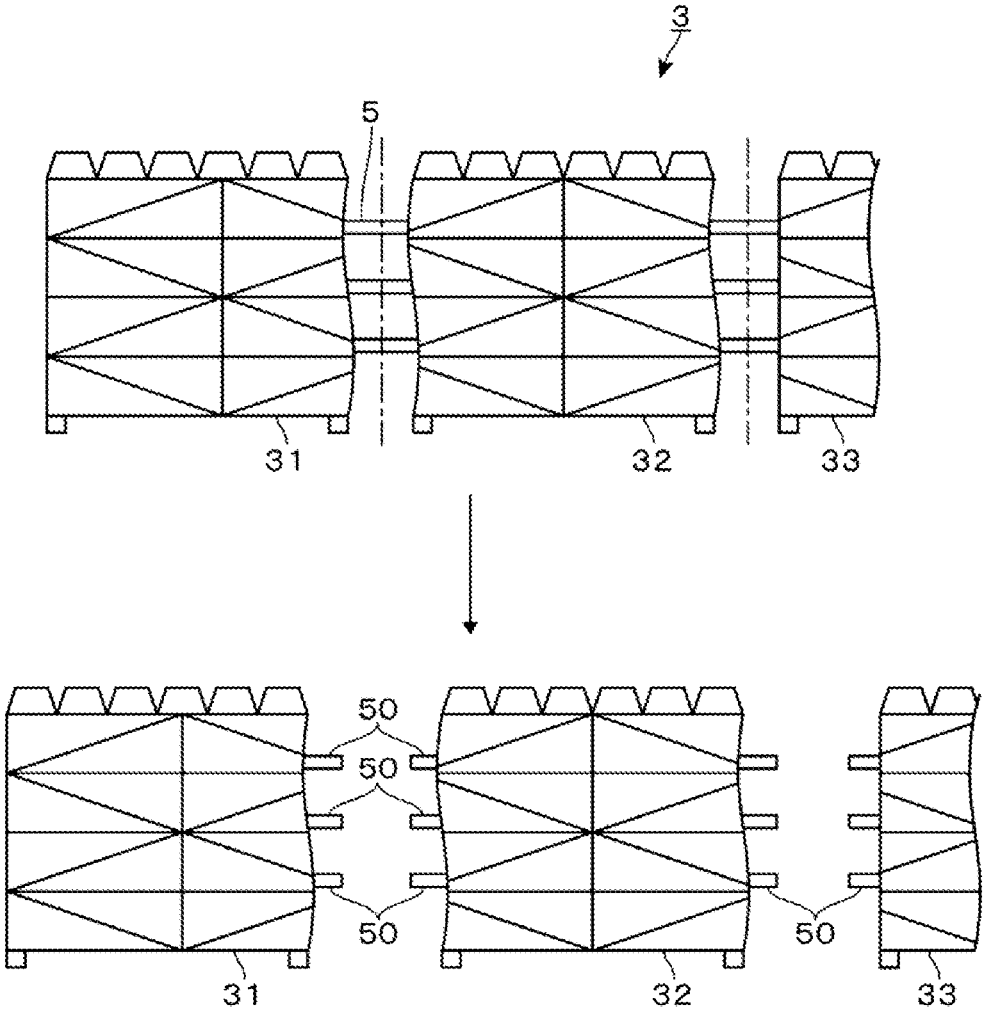
FIG. 3 is an explanatory view for illustrating division of the pipe rack.

As illustrated in FIG. 3, the frame structure forming the pipe rack 3 has a plurality of layers. In each layer, a large number of pipes 5 are arranged so as to extend in the long-side direction of the pipe rack 3. For the sake of easy illustration, in FIG. 3, FIG. 7 to FIG. 13, and other figures, a state in which one pipe 5 (pipe spool 50) is supported in each layer is schematically illustrated, but, in actuality, around 600 pipes 5 are supported in the entire pipe rack 3.

When such a pipe rack 3 is cut at appropriate positions in the long-side direction to divide the pipe rack 3 into the plurality of modules 31 to 34, cut end portions of the pipe spools 50 protrude from a side surface of the frame structure of each of the modules 31 to 34 after the cutting. The side surface of each of the modules 31 to 34 exposed by the cutting corresponds to a hook up surface to be coupled to other modules 31 to 34.

Those divided modules 31 to 34 are transported to the installation site of the plant to be installed in order. Meanwhile, the fabrication yard and the installation site of the pipe rack 3 may be separated away from each other by several thousands of kilometers or more. Further, when, for example, a transportation ship or a ground trailer is used to transport each of the modules 31 to 34, there is a limit to the number of transportation equipment that can transport each of the modules 31 to 34 having a length of about 100 m even after the division. Therefore, the individual divided modules 31 to 34 may be transported in order from the fabrication yard to the site in accordance with the installation timing so as to be installed, and the remaining modules may wait at the fabrication yard. Due to those circumstances, it may require time of, for example, about several months to transport the individual modules 31 to 34 to the installation site and install the modules 31 to 34 after the modules 31 to 34 are cut off.

As described above, when the modules 31 to 34 are transported and installed in order, for example, the module 31 forming one end portion in the long-side direction of the pipe rack 3 is first transported to the installation site to be installed. Then, the module 32 to be coupled to the installed module 31 is transported to the installation site to be installed. The transportation and installation work is similarly performed also for the remaining modules 33 and 34. In the following, the modules 31 to 34 are referred to as "first to fourth modules 31 to 34" in order of installation from the module 31 that is to be installed first.

Then, for example, after the second module 32 is installed subsequently to the installation of the first module 31, the end portions of the pipe spools 50 protruding from the hook up surfaces are connected to each other by, for example, welding. In this manner, the first module 31 and the second module 32 are coupled to each other in a horizontal direction via the hook up surfaces. This work is repeated so that the first module 31 to the fourth module 34 are coupled to each other in the horizontal direction. In this manner, the pipe rack 3 is manufactured at the installation site.

However, as described above, the distance between the fabrication yard and the installation site of the modules 31 to 34 may be long, and it may take time of about several months to transport each of the modules 31 to 34. Therefore, not only the climate differs between the fabrication yard and the installation site, but also the season changes. Thus, there may be a large temperature difference between a temperature at the fabrication yard before the start of transportation of the modules 31 to 34 and a temperature at the installation site after the transportation of the modules 31 to 34.

Figure 7:
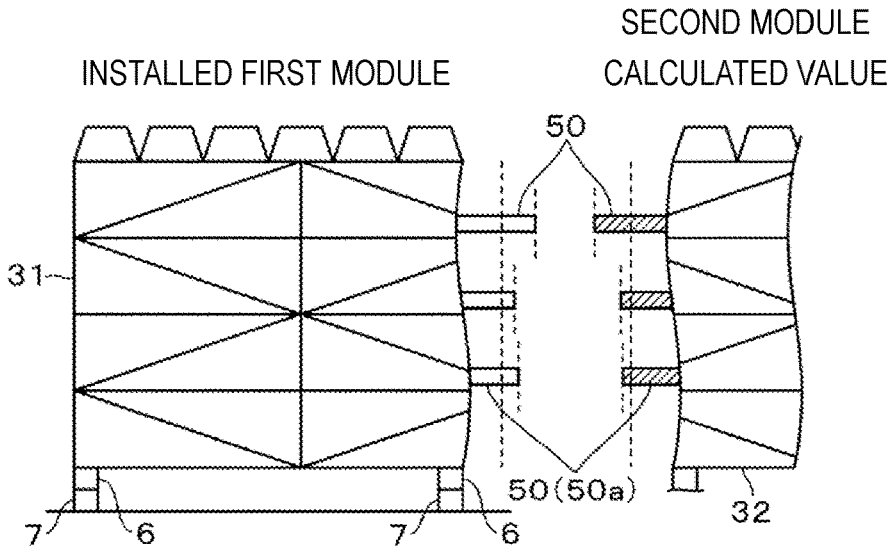
FIG. 7 is a first explanatory view for illustrating positional adjustment of end portions of pipes.

The large temperature difference before and after the transportation of the modules 31 to 34 causes, for example, expansion and contraction of each pipe spool 50 (FIG. 7). When an expansion and contraction amount increases, even when the modules 31 to 34 are arranged at the installation site at intervals equal to those at the time of cutting, the end portions of the pipe spools 50 protruding from the hook up surfaces may be brought into contact with each other or may be arranged in a separated manner. In particular, the pipe spools 50 may have expansion and contraction amounts differing from each other depending on their constituent materials and lengths even among the pipe spools 50 supported in the same module 31, 32, 33, or 34.

Meanwhile, when the pipe spools 50 are coupled to each other by welding, it is required to secure a gap between the end portions within a range of from about 3 mm to about 6 mm, corresponding to an amount to be shaved off at the time of cutting of the pipe 5. At this time, when the expansion and contraction amount differs for each pipe spool 50 as described above, for example, it is required to check whether or not the end portions of 1,200 pipe spools 50 in total protruding from the hook up surfaces of the modules 31 to 34 are located at positions weldable to each other. Further, as for the pipe spool 50 that is confirmed to be difficult to be welded, the position of the end portion is required to be adjusted individually.

As one method for solving the above-mentioned problem, there is conceivable a method in which, for example, when the first module 31 and the second module 32 are cut off, the pipe 5 is cut at two positions in its length direction to cut out a short pipe spool 50 for connection (hereinafter referred to as "pop piece"). Then, when each of the modules 31 and 32 is installed, the pipe spools 50 of those modules are connected to each other via the pop piece. At this time, when the interval between the end portions is decreased because the pipe spool 50 protruding from each of the modules 31 and 32 expands, shaving of the pop piece or other length adjustment is performed. On the other hand, when the interval between the end portions is increased because the pipe spool 50 is contracted, a new pop piece is prepared in accordance with the interval.

However, when the pop piece is used, after the modules 31 and 32 are installed at the site, it is required to adjust the length of the pop piece in accordance with the distance between the end portions of the pipe spools 50 extending from the modules 31 and 32. Further, it is required to weld both ends of the pop piece to the end portion of the pipe spool 50 on the first module 31 side and the end portion of the pipe spool 50 on the second module 32 side, respectively. Thus, there has been a problem in that the work at the site is increased, for example, welding locations are increased.

In view of this, in this embodiment, the expansion and contraction amounts of the plurality of pipe spools 50 caused by the temperature difference between the temperature at the fabrication yard before the start of transportation of the modules 31 to 34 and the temperature at the installation site after the transportation of the modules 31 to 34 are calculated in advance. Then, the installation positions of the modules 31 to 34 and the positions of the pipe spools 50 are adjusted so as to cancel out the expansion and contraction amounts. In this manner, the modules 31 to 34 are coupled to each other without using the above-mentioned pop piece, in principle.

First, for example, before the modules 31 to 34 are transported to the installation site, a computer calculates the expansion amounts of the pipes at the timing at which the modules 31 to 34 are installed. Table 1 shows a calculation table for calculating the expansion and contraction amount of the pipe spool 50. As the material of the pipe 5, for example, carbon steel, stainless steel, iron, or invar can be used.

TABLE 1

| Module | Pipe number | Material | Length L1 (m) | Temperature at manufacture T1 (° C.) | Temperature at installation T2 (° C.) | Expansion and contraction amount AL (mm) |
|---|---|---|---|---|---|---|
| First module | 1 | A | 100 | 0 | 25 | 30 |
| First module | 2 | A | 100 | 0 | 25 | 30 |
| First module | 3 | A | 100 | 0 | 25 | 30 |
| First module | 4 | A | 50 | 0 | 25 | 15 |
| . | | | | | | |
| . | | | | | | |
| . | | | | | | |
| Second module | 1 | B | 100 | 0 | 25 | 45 |
| Second module | 2 | C | 100 | 0 | 25 | 30 |
| . | | | | | | |
| . | | | | | | |
| . | | | | | | |

In the calculation table, pipe numbers are assigned to all of the pipe spools 50 for each of the modules 31 to 34. Further, when the material of each pipe spool 50 is input, a linear expansion coefficient $\alpha$ per unit temperature change is read out for each material to be set in association with each pipe spool 50. Then, for each pipe spool 50 of each of the modules 31 to 34, a length L1 of each pipe spool 50 immediately after the pipe rack 3 is divided to manufacture each of the modules 31 to 34 at the fabrication yard is accurately measured by laser measurement or other methods, and the length L1 is input for each pipe spool 50. The pipe 5 to be provided in the pipe rack 3 also includes a bent part bent in a direction crossing the long-side direction of the pipe rack 3. However, in this example, it is assumed that all of the pipes 5 are straight pipes extending along the long-side direction of the pipe rack 3, and the length of the pipe spool 50 along the long-side direction is measured as L1. Further, a temperature T1 at the time when the length measurement is performed is measured.

Next, a temperature T2 at a time point at which each of the modules 31 to 34 is transported and installed at the installation site is estimated. The temperature T2 may be estimated through use of, for example, a weather simulator, or may be estimated from previous weather data.

As described above, the temperature T1 at the time when the length of the pipe spool 50 is measured and the estimated temperature T2 at the installation site at the timing at which the modules 31 to 34 are installed at the installation site, which is estimated by, for example, simulation, are identified. The temperatures are input to the computer described above.

For example, Expression (1) below is input to the computer so that an expansion and contraction amount ΔL of each pipe spool 50 caused when each of the modules 31 to 34 is installed at the installation site is calculated based on values of items input to the table.

$$\text{Expansion and contraction amount } \Delta L = L1 \times \alpha \times (T2 - T1) \qquad \text{Expression (1)}$$

Then, a change amount (having a unit of, for example, mm) is calculated. The change amount corresponds to an amount of change of each of positions of both ends of the pipe spool 50 from the positions at the time of manufacture (at the time of measurement of the temperature T1) when each pipe spool 50 expands or contracts by the calculated expansion and contraction amount. For example, when the change amount is calculated, it is assumed that a predetermined position, for example, a center of the pipe spool 50 does not change regardless of the temperature difference (T2−T1). In this case, as shown in Table 2, the change amount of the position of the end portion of the pipe spool 50 protruding from the hook up surface of each of the modules 31 to 34 can be calculated based on the expansion and contraction amount ΔL.

TABLE 2

| Pipe number | Change amount on one end side (mm) | Change amount on another end side (mm) |
|---|---|---|
| 1 | 15 | 15 |
| 2 | 15 | 15 |
| 3 | 15 | 15 |
| 4 | 7.5 | 7.5 |

Then, when each of the modules 31 to 34 is installed, the installation position is adjusted so that the change amount of the position of the end portion of the pipe spool 50 is canceled out. In this case, when the change amount of the position of the end portion of the pipe spool 50 is canceled out, it is also conceivable to adopt a method of, for example, individually moving each pipe spool 50 to adjust the pipe spool 50 after each of the modules 31 to 34 is installed. However, in recent years, there is a demand for reduction in work at the site, and hence it is preferred to reduce the movement of the pipe spool 50 after each of the modules 31 to 34 is installed as much as possible.

In view of this, when each of the modules 31 to 34 is installed, the installation position of each of the modules 31 to 34 itself is shifted so that the change of the position of the pipe spool 50 is canceled out. As a method of shifting the installation position, the installation position of each of the modules 31 to 34 with respect to a foundation 7 to be described later, which is provided on the ground of the installation site, is adjusted. A method of setting an adjustment amount (offset value) for adjusting the installation position of each of the modules 31 to 34 is described later.

Figure 4:
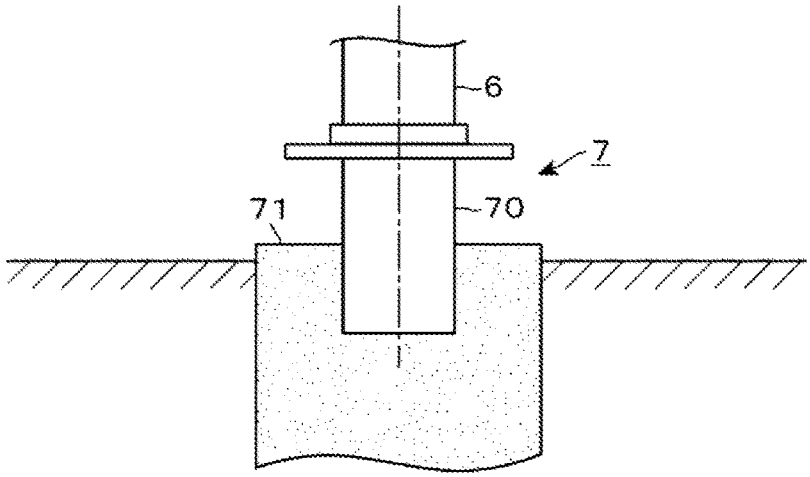
FIG. 4 is a side view for illustrating an overall configuration of a foundation on which a module is to be installed.

In this case, as illustrated in FIG. 4, each of the modules 31 to 34 includes a column base 6. The column base 6 is connected onto the foundation 7 installed in advance on the ground of the installation site so that each of the modules 31 to 34 is installed. As illustrated in FIG. 4, a main body portion 70 on a lower portion side of the foundation 7 is buried into concrete 71 casted on the ground. In this manner, the foundation 7 is fixed, and an arrangement position of the foundation 7 is determined.

When the column base 6 is connected to the foundation 7 whose arrangement position is fixed in advance as described above, for example, a state in which the center of each foundation 7 and the center of the column base 6 are aligned is set as a reference position. Meanwhile, when the installation position of each of the modules 31 to 34 is adjusted as described above, the column base 6 is connected while shifting the column base 6 from the reference position in, for example, a direction to cancel out the change amount of the end portion of the pipe spool 50.

Figure 5:
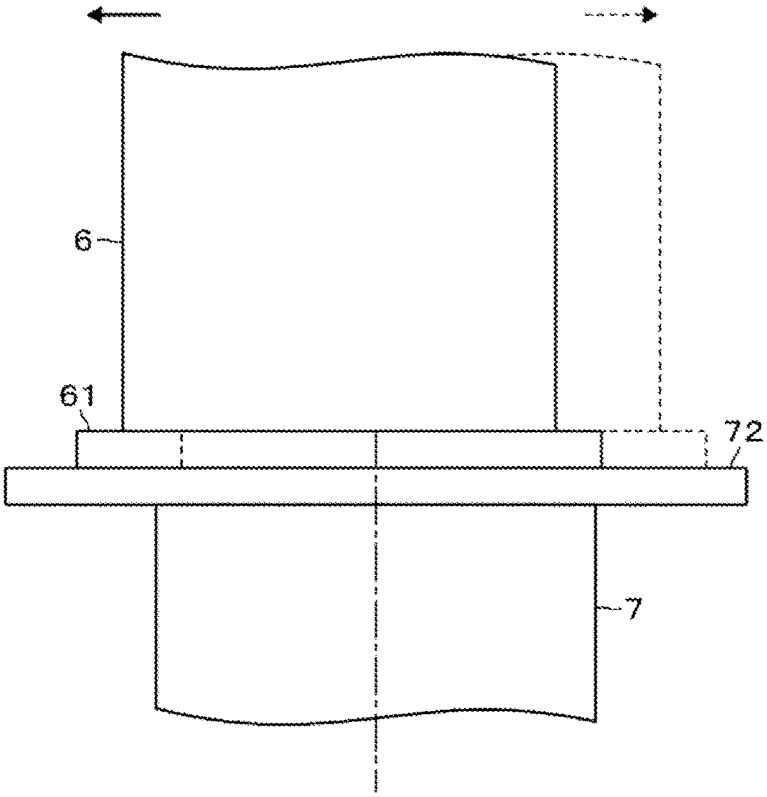
FIG. 5 is an enlarged view for illustrating a connection state between the module and the foundation.

Such adjustment of the installation position can be performed by, for example, as illustrated in FIG. 5, providing a flange 72 to an upper end portion of the foundation 7 and providing a flange 61 to a lower end portion of the column base 6, and shifting positions at which the flanges 72 and 61 are fixed to each other.

However, when the positional shift of the column base 6 from the reference position is increased, a large force acts in a direction to bend the foundation 7, and hence there is a limit to the adjustment of the installation position by shifting the connection position of the column base 6 with respect to the foundation 7. In this example, a shift amount of the column base 6 with respect to the reference position (corresponding to the above-mentioned adjustment amount) has an allowable range of from about 10 mm to about 15 mm at the maximum.

Figure 6:
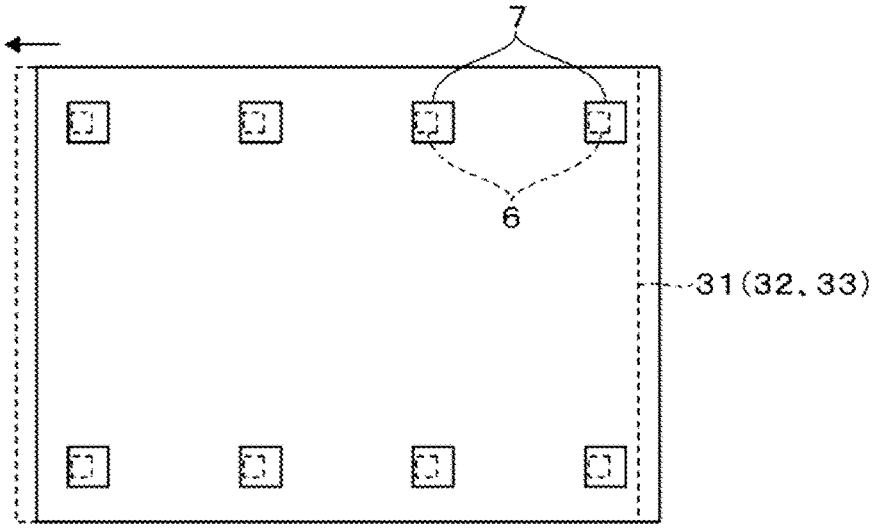
FIG. 6 is a plan view for illustrating connection positions of the module with respect to the foundation.

Therefore, as illustrated in FIG. 6, even when the installation position of each of the modules 31 to 34 (column base 6) with respect to the foundation 7 is adjusted based on the offset value, the adjustment amount is limited in the allowable range of the foundation 7 (in the above-mentioned example, from about 10 mm to about 15 mm).

When the offset value obtained by a method to be described later is within the allowable range of the foundation 7 of this example, the installation position is adjusted based on the offset value so that the change amount of the position of the end portion of the pipe spool 50 is canceled out. On the other hand, when the calculated offset value exceeds the allowable range (in a case of conflicting with the limit to the offset value), as for the change amount that cannot be fully canceled out only through the adjustment of the installation position, for example, positional adjustment of the end portion is performed for individual pipe spools 50.

With reference to FIG. 8 to FIG. 13, description is given of specific examples of steps of transporting the modules 31 to 34 manufactured at the fabrication yard to the installation site and installing the modules 31 to 34 to manufacture the pipe rack 3, based on the method described above.

At the beginning, as described with reference to FIG. 3, first, the pipe rack 3 is manufactured at the fabrication yard, and the pipe rack 3 is cut to divide the pipe rack 3 into the plurality of modules 31 to 34 (step of fabricating modules).

After the modules 31 to 34 are divided, the lengths of the pipe spools 50 of each of the modules 31 to 34 are measured, and the expansion and contraction amounts of the pipe spools 50 caused by the temperature difference after each of those modules 31 to 34 is transported to the installation site are calculated by the above-mentioned method (step of calculating expansion and contraction amounts of the pipe spools 50).

After that, the offset value corresponding to the adjustment amount of the installation position of each of the modules 31 to 34 is obtained so as to cancel out the expansion and contraction amounts.

One example of the method of obtaining the offset value is described. As for the first module 31 to be transported to the installation site first, interference amounts of the pipe spools 50 of the adjacent modules 31 and 32 are calculated based on the change amounts of the pipe spools 50 supported by the first module 31, and the offset value is determined based on the maximum value of the interference amounts. However, when part of the pipe spools 50 protrudes and causes a large interference, it is simultaneously considered to physically move the pipe 5 to decrease the offset value.

At this time, for example, the offset value obtained by the above-mentioned method may differ between one end side and another end side of the first module 31. In this case, the adjustment amount to be used when the first module 31 is connected to the foundation 7 also differs between the one end side and the another end side. However, the difference in the change amount between the one end side and the another end side is very small as compared to the size of the entire module 31, and hence the difference value is absorbed by deflection or the like of the frame structure.

After the installation position of the first module 31 is determined based on the offset value, the offset value for the installation position of the second module 32 is obtained. In this case, as illustrated in FIG. 7, the second module 32 is arranged so that the hook up surface to be coupled to the first module 31 is adjacently opposed to the hook up surface of the first module 31. Meanwhile, as described above, the offset value is already determined for the hook up surface on the first module 31 side, and hence, as a result of adjusting the installation position based on the offset value, the position of the end portion of each pipe spool 50 can be identified.

In view of this, the offset value of one end on the hook up surface side of the second module 32 is determined with the position of the end portion of the pipe spool 50 on the first module 31 side as a reference.

That is, the offset value is determined so that the end portion of the pipe spool 50 on the second module 32 side can be arranged at a position at which the end portion can be welded to the end portion of the pipe spool 50 on the first module 31 side.

At this time, each of the modules 31 and 32 supports a large number of pipe spools 50, and those pipe spools 50 include a pipe spool 50*a* that is difficult to move to individually adjust the position of the end portion for reasons such as large diameters.

In this example, such a pipe spool 50*a* that is difficult to individually adjust the position is selected as "one pipe spool" for determining the offset value. Then, the offset value is determined within the above-mentioned limit range caused by the strength restriction on the foundation 7 side, so that the end portions of the pipe spools 50*a* are arranged at weldable positions (gap between the end portions is from 3 mm to 6 mm) without being brought into contact with each other.

Figure 8:
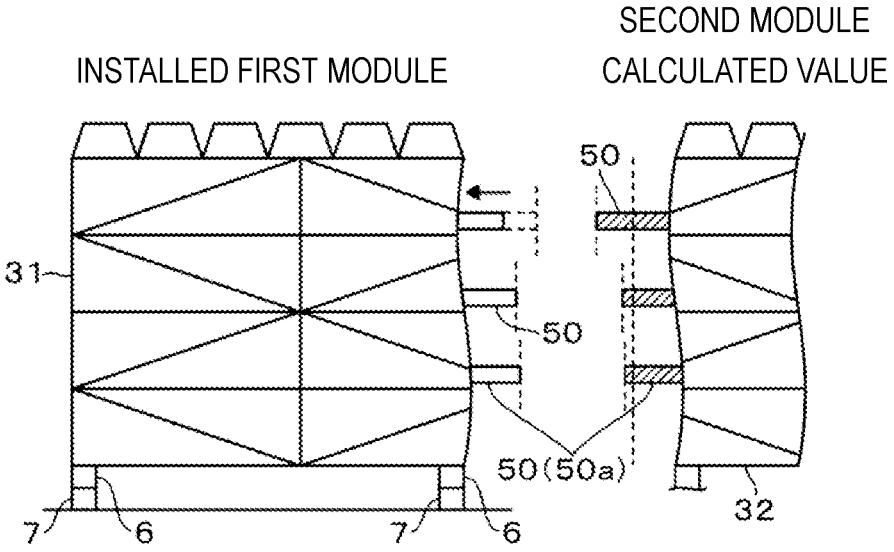
FIG. 8 is a second explanatory view for illustrating the positional adjustment of the end portions of the pipes.

On the other hand, as a result of determining the offset value by the above-mentioned method, when the end portions are brought into contact with each other or a gap that causes difficulty in welding is formed in the pipe spool 50 other than the pipe spool 50*a* that is difficult to individually adjust the position, the pipe spool 50 supported by the frame structure is moved or the end portion thereof is cut so that positional adjustment is individually performed (FIG. 8).

The inventors of the present invention recognize that, when the offset value is determined and the installation position is adjusted by the above-mentioned method, among the pipe materials 50 included in the 600 pipes 5, about 10% to 20% of them are required to individually adjust their positions, and the number of pipe spools 50 that are required to cut their end portions can be reduced to about several of them.

Then, the offset value can be determined by a method similar to that in the above-mentioned example also for between the hook up surfaces on another end side of the second module 32 and one end side of the third module 33, and for between the hook up surfaces on another end side of the third module 33 and one end side of the fourth module 34.

That is, the offset value for the another end side of the module 32 or 33 to be installed earlier is determined based on an average value of the change amounts of the pipe spools 50. Further, the offset value for the another end side of the module 33 or 34 to be installed later is determined so that the end portions of the pipe spools 50*a* are located at weldable positions with reference to the position of the end portion of the pipe spool 50*a* that is difficult to individually adjust the position in the hook up surface with respect to the module 32 or 33 installed earlier. The offset value for the another end side of the remaining fourth module 34 may be determined based on, for example, an average value of the change amounts of the pipe spools 50.

Figure 9:
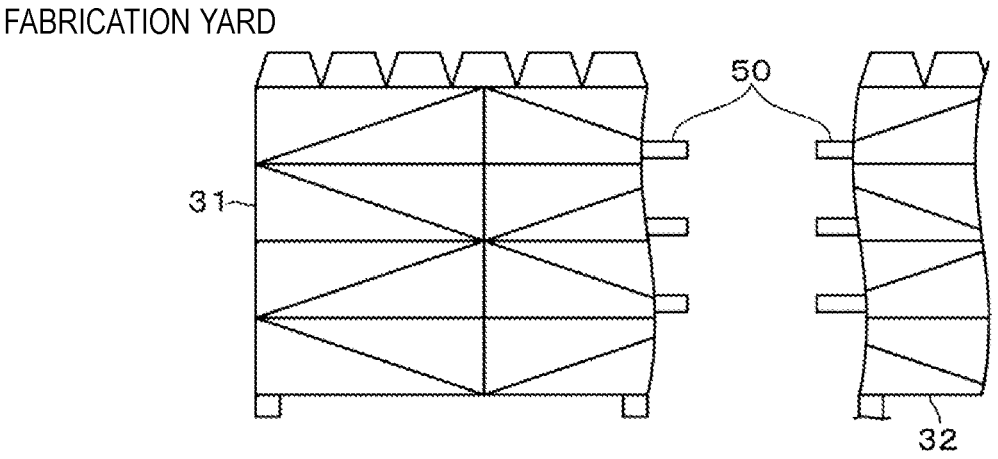
FIG. 9 is a first explanatory view for illustrating transportation and installation of a first module.
Figure 10:
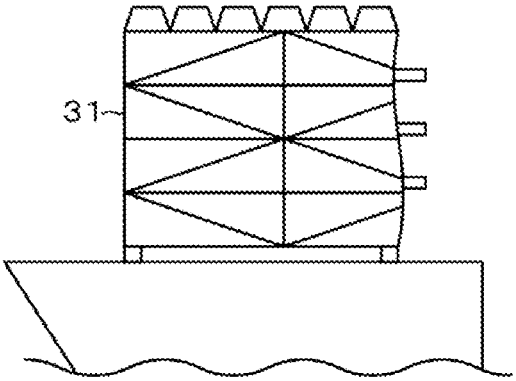
FIG. 10 is a second explanatory view for illustrating the transportation and the installation of the first module.

In parallel to investigation of the adjustment of the installation position of each of the modules 31 to 34 described above (determination of the offset value), among those modules 31 to 34, the first module 31 on the one end side is mounted on a transportation ship or other transportation equipment to transport the first module 31 from the fabrication yard to the installation site (FIG. 9 and FIG. 10, step of transporting the module).

Figure 11:
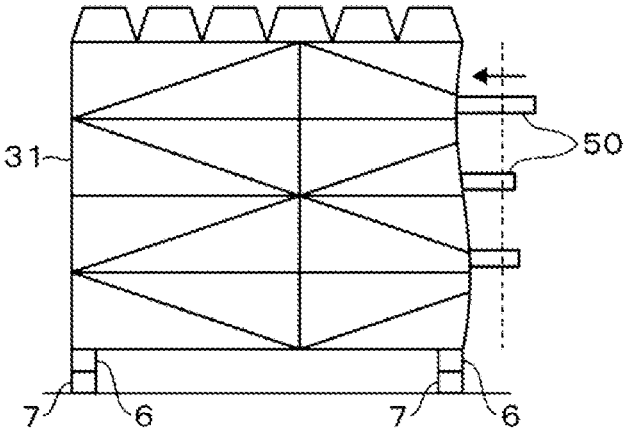
FIG. 11 is a third explanatory view for illustrating the transportation and the installation of the first module.
Figure 12:
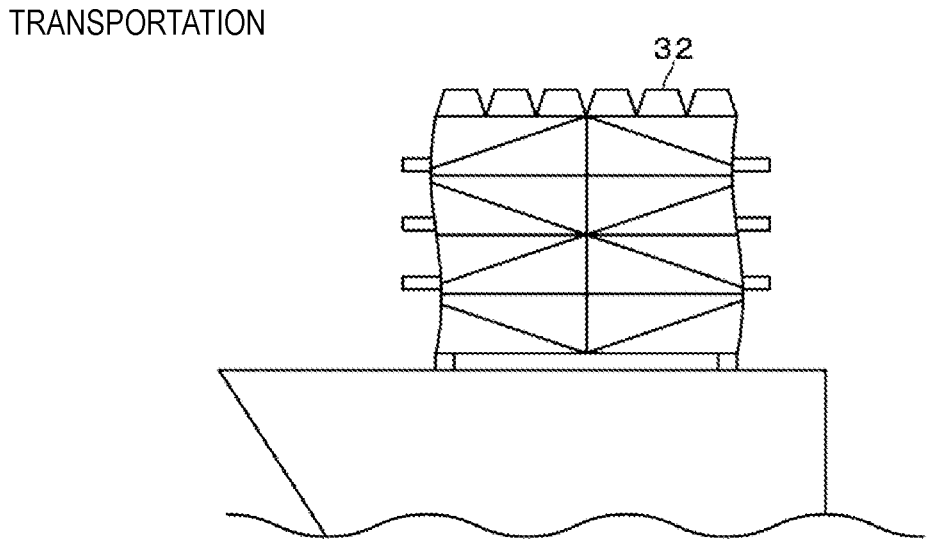
FIG. 12 is a first explanatory view for illustrating transportation and installation of a second module.

After the first module 31 arrives at the installation site, the first module 31 is connected to the foundation 7 while shifting the first module 31 from the reference position in a direction to cancel out the expansion and contraction amounts based on the offset value calculated in advance (FIG. 11, step of adjusting the installation position of the module and step of installing the module). In this case, until the next second module 32 is transported to the installation site, work of moving the pipe spool 50 or cutting the end portion thereof is performed for the pipe spool 50 that is required to individually adjust the position when the second module 32 is installed (FIG. 8, step of adjusting the position of the end portion of the pipe spool).

Figure 13:
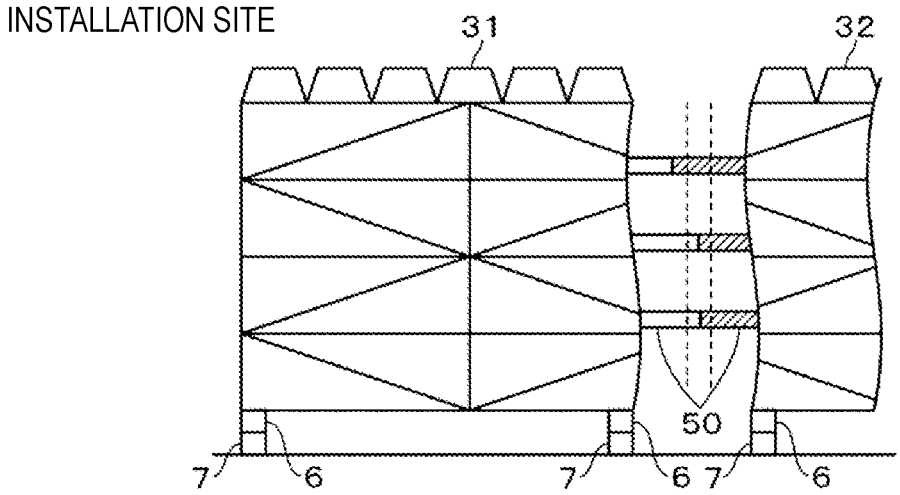
FIG. 13 is a second explanatory view for illustrating the transportation and the installation of the second module.

Next, the second module 32 is transported from the fabrication yard to the installation site (FIG. 12, step of transporting the module), and the second module 32 is installed at a position at which the hook up surfaces are adjacently opposed to each other between the first module 31 and the second module 32 (FIG. 13, step of installing the module). At this time, the installation position of the second module 32 is adjusted based on the offset value determined by the method described with reference to FIG. 7 and FIG. 8.

As described above, the installation position of each of the modules 31 and 32 and the position of the end portion of the individual pipe spool 50 are adjusted toward the direction to cancel out the expansion and contraction amount of each pipe spool 50 in advance. As a result, the end portions of the modules 31 and 32 are arranged at positions opposed to each other via a gap (3 mm to 6 mm) suitable for welding. After that, the end portions of the pipe spools 50 opposed to each other via the gap are connected to each other by welding to form the pipe 5.

Also for the remaining third module 33 and fourth module 34, transportation, adjustment of the installation position, and adjustment of the position of the end portion of the pipe spool 50 are performed based on the procedure described above. After that, the end portions of the pipe spools 50 are connected to each other to form the pipe 5. Through those steps, the pipe rack 3 corresponding to the plant facility of this embodiment is manufactured.

As described above, the positions of the end portions of the pipe spools 50 opposed to each other via the hook up surfaces of the modules 31 to 34 are adjusted so as to cancel out the expansion and contraction amounts of the pipe spools 50 caused by the temperature difference between the fabrication yard and the installation site of each of the modules 31 to 34. Therefore, the pipe spools 50 of both of the modules 31 and 32 can be connected to each other without using a pop piece or other spools.

According to the above-mentioned embodiment, the first to fourth modules 31 to 34 are conveyed in order from the fabrication yard to the installation site, and the expansion and contraction amounts of the pipe spools 50 are calculated based on the temperature difference between the temperature at the fabrication yard when the modules 31 to 34 are manufactured and the temperature at the installation site when the modules 31 to 34 are installed at the installation site. Further, the installation position of the foundation 7 is adjusted toward the direction to cancel out the expansion and contraction amounts of the plurality of pipe spools 50, and the pipe spool 50 is moved toward the direction to cancel out the expansion and contraction amounts of the plurality of pipe spools 50, so that the modules 31 to 34 are installed with the positions of the end portions of the pipe spools 50 being adjusted. Therefore, when the modules 31 to 34 are installed at the installation site, the modules 31 to 34 are arranged at positions suitable for connection of the pipe spools 50 of the modules 31 to 34. Thus, the work at the site can be reduced.

Further, in this embodiment, when each of the modules 31 to 34 is placed on the foundation 7 having a limit to the adjustment amount of the installation position, first, the installation position is adjusted to cancel out the expansion and contraction amounts of the pipe spools 50. In this manner, the work at the site after the modules 31 to 34 are installed can be reduced.

Further, the pipe 5 to be installed on the pipe rack 3 differs in thickness and structure for each pipe 5. Therefore, for example, the installation position of each of the modules 31 to 34 may be adjusted so that the position of the end portion of the pipe spool 50 that is most difficult to move is to be arranged at a position set in advance. Then, other pipe spools 50 may be moved to adjust the positions of the end portions of the pipe spools 50.

Further, it is preferred to perform the step of adjusting the position of the end portion of the pipe spool 50 for the pipe spool 50 on the side of the module 31, 32, 33, or 34 installed earlier at the installation site.

It is not required to perform both of adjusting the installation position of each of the modules 31 to 34 toward the direction to cancel out the expansion and contraction amounts of the plurality of pipe spools 50 with respect to the foundation 7 arranged in advance at the installation site and individually adjusting the position of the end portion of the pipe spool 50 supported by each of the modules 31 to 34 toward the direction to cancel out the expansion and contraction amounts of the plurality of pipe spools 50. Only one of those adjustment steps may be performed.

Moreover, the present invention is not limited to a case in which the plurality of modules 31 to 34 are formed by cutting the plant facility, for example, the pipe rack 3 manufactured in advance. After the plurality of modules are individually manufactured, the modules may be conveyed to the installation site and coupled to each other in the horizontal direction, to thereby manufacture the plant facility.

Further, the plant facility manufactured by hook up the plurality of modules 31 to 34 to each other in the above-mentioned example is not limited to the pipe rack 3. The present invention is also applicable to plant facilities, in which various types of equipment to be provided in various plants are provided, and which include racks corresponding the frame structures supporting the pipes 5 connected to those various types of equipment. Examples of the various plants include, in addition to the LNG plants configured to liquefy natural gas, natural gas plants configured to separate and recover natural gas liquid, petroleum refining plants configured to distill or desulfurize crude oil or various intermediates, and chemical plants configured to produce petrochemical products, intermediate chemicals, or polymers.

The invention claimed is:

1. A fabrication method of a plant facility, which is to be provided in a plant configured to perform fluid treatment, and includes a pipe through which fluid is allowed to flow, the method comprising the steps of:

fabricating a plurality of modules at a fabrication yard differing from an installation site of the plant facility, the plurality of modules including:

a plurality of pipe spools that configures the pipe;

frame structures, each configured to support the plurality of pipe spools; and hook up surfaces, formed on side surfaces of the frame structures, wherein end portions of the plurality of pipe spools are positioned on the side surfaces of the frame structures, the end portions of the plurality of pipe spools are exposed on the hook up surfaces, at least a part of the end portions of the plurality of pipe spools are protruded from the hook up surfaces, and the plurality of modules is configured to be coupled to each other in a horizontal direction via the hook up surfaces to form the plant facility;

transporting each of the plurality of modules manufactured at the fabrication yard to the installation site of the plant facility;

calculating, in advance, for the each of the plurality of modules, expansion and contraction amounts of the plurality of pipe spools caused by a temperature difference between a temperature at the fabrication yard before start of transportation of the each of the plurality of modules and a temperature at the installation site after the transportation of the each of the plurality of modules;

installing the each of the plurality of modules while performing at least one of the steps of:

adjusting an installation position of the each of the plurality of modules with respect to a foundation toward a direction to cancel out the expansion and contraction amounts of the plurality of pipe spools, the foundation being arranged in advance at the installation site so that the hook up surfaces to be coupled to each other of the plurality of modules are allowed to be adjacently opposed to each other; and adjusting a position of an end portion of at least one pipe spool of the plurality of pipe spools supported by the frame structures toward the direction to cancel out the expansion and contraction amounts of the plurality of pipe spools; and connecting end portions of the plurality of pipe spools opposed to each other of the plurality of modules having the hook up surfaces arranged adjacently to each other to form the pipe, to thereby manufacture the plant facility.

2. The fabrication method of a plant facility according to claim 1, wherein, when the step of adjusting the installation position of the each of the plurality of modules is performed and an adjustment amount of the installation position of the each of the plurality of modules with respect to the foundation is exceeded an allowable range of 10 mm to 15 mm, the step of adjusting the position of the end portion of the pipe spool is performed.

3. The fabrication method of a plant facility according to claim 2, wherein, in the step of installing the each of the plurality of modules while adjusting the installation position, the adjustment amount of the installation position is set so that a gap of 3 mm to 6 mm, which is a weldable gap, is arranged between a position of an end portion of a selected pipe spool selected from the plurality of pipe spools supported by the frame structures and a position of an end portion of an pipe spool to be connected, and wherein the step of adjusting the position of the end portion of the pipe spool is performed for at least a part of the plurality of pipe spools other than the selected pipe spool.

4. The fabrication method of a plant facility according to claim 2, wherein the step of adjusting the position of the end portion of the pipe spool is performed on installed pipe spools of a module installed earlier at the installation site.

5. The fabrication method of a plant facility according to claim 1, wherein the step of fabricating the each of the plurality of modules includes a step of fabricating the plant facility at the fabrication yard, and then dividing the plant facility into the plurality of modules.

* * * * *